US005423250A

United States Patent [19]

Anderson et al.

[11] Patent Number: 5,423,250

[45] Date of Patent: Jun. 13, 1995

[54] AUTOMATIC SLICING MACHINE

[75] Inventors: Paul S. Anderson, Astoria; Garold L. Wygal, Durham, both of Oreg.

[73] Assignee: Carruthers Equipment Co., Warrenton, Oreg.

[21] Appl. No.: 285,238

[22] Filed: Aug. 3, 1994

Related U.S. Application Data

[63] Continuation-in-part of Ser. No. 63,402, May 17, 1993.

[51] Int. Cl.[6] ..... B26D 3/18

[52] U.S. Cl. ..... 99/537; 99/538; 83/404; 83/404.2

[58] Field of Search ..... 99/537, 538, 567, 485, 99/486; 83/404, 404.1, 404.2

[56] References Cited

U.S. PATENT DOCUMENTS

| | | | |
|---|---|---|---|
| 1,028,510 | 6/1912 | Wefing | 83/404.1 |
| 2,541,180 | 2/1951 | Urschel et al. | 83/403 |
| 3,380,494 | 4/1968 | Mayo | 83/404.1 |
| 3,841,186 | 10/1974 | Demerin | 83/404.2 |
| 3,990,336 | 11/1976 | Soodalter | 83/404.2 |
| 4,031,789 | 6/1977 | Soodalter | 83/404.2 |
| 4,329,900 | 5/1982 | Dennis et al. | 83/355 |
| 4,782,729 | 11/1988 | Mathot | 83/408 |
| 5,271,304 | 12/1993 | Wygal et al. | 83/422 |

*Primary Examiner*—David A. Scherbel

*Assistant Examiner*—Patrick F. Brinson

*Attorney, Agent, or Firm*—Robert L. Harrington

[57] ABSTRACT

A machine for slicing a food product in the three dimensions in a single continuous cycle to produce an end product having a determined size and shape. The machine incorporates a first slicing station for slicing a determined length of a first slice off the food product by a first pair of synchronously driven and counter rotating cut off knives and a second slicing station to slice the first slice in two dimensions by a set of gang knives and a second pair of synchronously driven and counter rotating cut off knives to produce a cube of a determined size and shape. The machine has a conveyor system for conveying the food product on a continuous basis through the machine. The rotation of the cut off knives are variable and are set in conjunction with the feed rate of the conveyor system to establish the desired dimensions of the end product. The first slice is transferred onto the conveyor of the second slicing station in a manner to accommodate slicing the first slice in the other two dimensions by the second slicing station. The arrangement of two counter rotating cut off knives at each slicing station facilitates slicing a food product having an extended width whether the width be the width of a single food product or the combined widths of multiple food products placed side by side on the conveyor system.

8 Claims, 3 Drawing Sheets

AUTOMATIC SLICING MACHINE

This application is a continuation-in-part of the application titled THREE DIMENSIONAL AUTOMATIC FOOD SLICER, Ser. No. 063,402 filed May 17, 1993 and is incorporated herein in its entirety by reference.

U.S. Pat. No. 5,271,304 (Ser. No. 876,123) owned by the assignee of the present invention is incorporated by reference into the present disclosure.

FIELD OF THE INVENTION

This invention relates to automatic slicing machines, e.g., for slicing fillets or slabs of food product into uniform pieces such as cubes and the like. More particularly, it relates to a slicing blade arrangement for slicing wide fillets or slabs.

BACKGROUND OF THE INVENTION

Slicing machines of the type contemplated herein are often used for cutting a food product of a generally large size such as fillets (or slabs) of fish, meat or other food products into cubes, e.g., to be used for canning. The machine is preferably of the type that has the capability of performing three dimensional slicing, that is it will cut the food product to a determined width, height and length of cube having the dimensions desired for further processing.

A slicing machine as generally described above is disclosed in U.S. Pat. No. 5,410,954 (Ser. No. 063,402). This patent is owned by the assignee of the present invention. As previously stated, the disclosure of this patent is incorporated by reference into the present disclosure.

More recently there has become a need to slice or dice food products such as fillets having a much greater width into cube like pieces having a determined width, height and length. This presents a problem for the cutoff or slicing blade(s). Whereas the blade pivots (slices) down through the fillet with the outer portion of the cutting edge trailing the inner portion, the wider the fillet, the longer it takes the blade to go through the width of the fillet. The fillet preferably continues to move relative to the cutoff or slicing blades as it is being sliced and the fillet, therefore, pushes against the blade as the blade travels down through the food product. This is not a problem if the blade rapidly slices through the fillet but achieving the desired speed is far more difficult with a blade sufficiently large to slice a wider fillet.

Also, whereas the path of the pivoting blade is a circle having a radius defined by the length of the blade from pivot point to its outer tip, a longer blade, e.g., two feet in length, will pivot through a circle that has a four foot diameter. Guards have to be provided and all of the remaining components, including the machine base or support, have to be built around the four foot plus circular area of the pivoting blade. This even creates a problem as to machine height. The desirable cutting width may easily exceed the nominal 20 inches provided by the two foot blade.

BRIEF SUMMARY OF THE INVENTION

The present invention provides for the slicing of an extended width food product by providing a pivoting blade at each side of the conveyor generated pathway. The blades are counter rotating, they rotate or pivot essentially through the same plane and they are synchronized so that they slice down through the fillet at the same time. There is a slight overlap of the blade tips but the tips are designed/arranged so that one follows the other in close relationship.

The problems associated with a single large blade are in effect halved. The same rotative speed will achieve the full width slicing of the fillet in about half the time and crowding of the moving fillet against the blades is alleviated. The blades being positioned side by side, the height of the pivoting blade path is half that of a single blade having similar width cutting capability.

These and other advantages will become apparent upon reference to the following detailed description and drawings referred to therein.

DESCRIPTION OF THE PREFERRED EMBODIMENT

Figure 1:
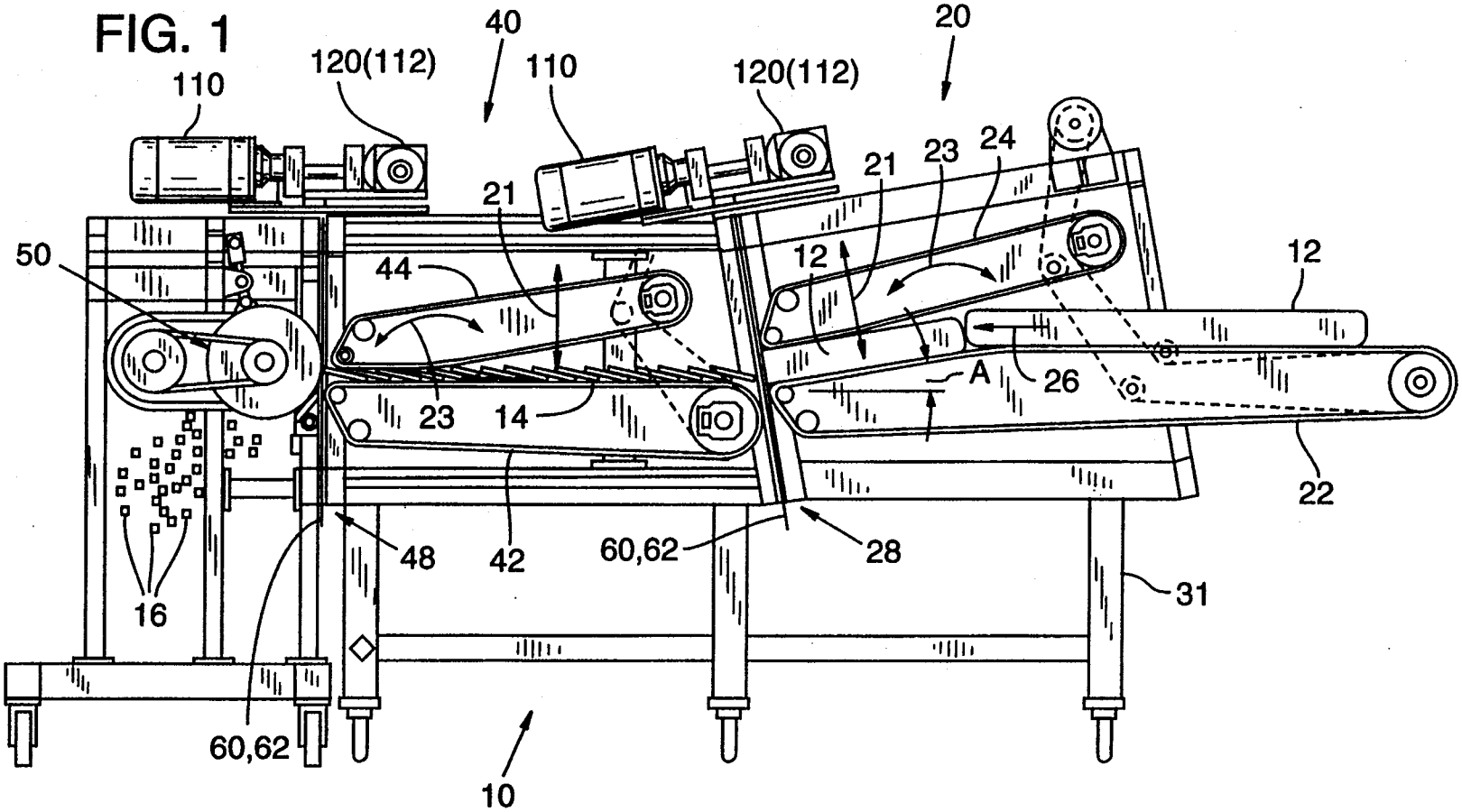
FIG. 1 is a front view of the automatic three dimensional slicing machine of the present invention.
Figure 2:
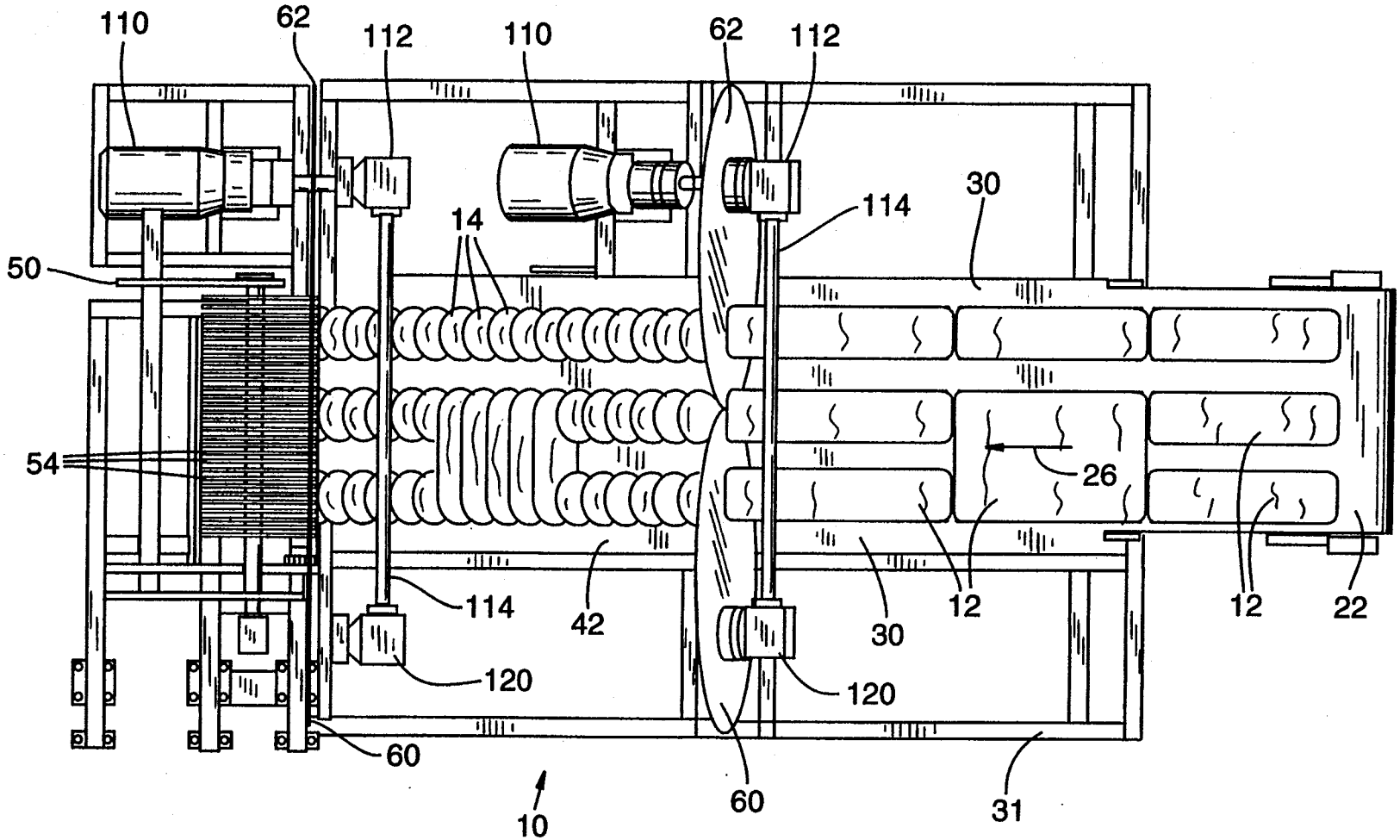
FIG. 2 is a top view of the automatic three dimensional slicing machine of FIG. 1.

Refer to FIGS. 1 and 2 of the drawings which illustrate the automatic three-dimensional slicing machine 10 of the present invention. The slicing machine 10 has a first slicing unit 20 and a second slicing unit 40. The slicing unit 20 and the slicing unit 40 may be provided as separate units or they may be mounted on a common frame 31 as shown in FIGS. 1 and 2. The slicing machine 10 is arranged to automatically slice a food product such as a fillet 12 into cube-like end products (cubes 16) having a determined width, height and length. The slicing machine 10 of the present invention is particularly suited to slicing a food product 12 having an extended width.

The slicing unit 20 has a conveyor system comprising a bottom conveyor 22 and an upper conveyor 24. The conveyors 22, 24 are preferably belt type conveyors. The slicing unit 20, in particular the conveyors 22, 24 and the slicing blades 60, 62 are inclinable at an angle, the angle being designated by the letter A in FIG. 1. The slicing unit 20 of the machine 10 is supported on the frame 31. The angle of the slicing unit 20 is inclined at an angle to accommodate product layering onto the conveyor of slicing unit 40 in such a fashion that the second cut accommodates a proper cube shape. This angle is determined based on the specific application requirements and may be fixed or adjustable based on application and user needs.

The upper conveyor 24 is adjustable relative to the bottom conveyor 22 as indicated by arrow 21 and the upper conveyor 24 is further tiltable relative to the travel path of the bottom conveyor 22 as indicated by the directional arrow 23. The upper conveyor 24 is adjustably yieldably biased downward toward the bottom conveyor 22 and thus the upper conveyor 24 has what is referred to as a float capability. The bottom conveyor 22 and the upper conveyor 24 are driven in unison with the rate of travel of the conveyors 22, 24 being variable. The conveyors 22, 24 may be driven at a continuous rate or alternatively may have a step feed arrangement.

The slicing unit 20 has two counter rotating blades 60, 62 positioned adjacent the exit end 28 of conveyors 22, 24 (best seen in FIG. 2). The blades 60, 62 define a slicing station of the slicing unit 20. The blades 60, 62 incline with the conveyors 22, 24. The blades 60, 62 counter rotate one to the other and are driven synchronously. The blades 60, 62 rotate essentially on the same plane and have their outer tips overlapping the plane of travel of the other blades. The blades 60, 62 are synchronously driven with one blade leading or lagging the other such that the outer tips of the blades will never interfere one with the other. The rotational rate of the blades 60, 62 may be varied and is set in conjunction with the feed rate of the lower and upper conveyors 22, 24. The blades 60, 62 have a spiral-like configuration and preferably have multiple cutting edges or sectors 61 (best seen in FIGS. 3 and 5) that enables the continuous feeding of a food product 12 into the rotational path of the blades 60, 62.

The second slicing unit 40 is positioned adjacent the first slicing unit 20. The slicing unit 40 has a conveyor system comprising a bottom conveyor 42 and an upper conveyor 44 that is arranged in the same manner as the conveyors 22, 24 of the first slicing unit 20 except that in this embodiment there is no provision for tilting the conveyors. The conveyors 42, 44 are preferably belt type conveyors. The upper conveyor 44 of the slicing unit 40 is adjustably yieldably biased toward the bottom conveyor 42 and may be adjusted toward and away from the bottom conveyor 42 as indicated by arrow 21. The upper conveyor 44 also has tilt capability as indicated by arrow 23.

The upper conveyors 24, 44 are not shown in FIG. 2 for drawing clarity.

The slicing unit 40 has another set of counter rotating blades 60, 62 positioned at the exit end 48 of the lower conveyor 42 and the upper conveyor 44. A set of gang knives 50 are placed adjacent the blades 60, 62 of the slicing unit 40 and the gang knives 50 are in line with the feed path of the lower conveyor 42 and upper conveyor 44 of the slicing unit 40. The blades 60, 62 in combination with the gang knives 50 define a slicing station of the slicing unit 40.

In operation, a food product designated by numeral 12 is received on the bottom conveyor 22 of the first slicing unit 20. The direction of conveyance (travel direction) of the conveyors of the slicing units 20, 40 is indicated by the directional arrow 26. The conveyors of the slicing units 20, 40 define a pathway having a travel direction 26 being bounded by opposed sides 30, the sides of the pathway being the sides of the conveyors of the slicing units 20, 40.

It will be appreciated that the food product 12 will vary in size, the size being variable in height, width and length and accordingly as shown in FIG. 2, various sizes of the food product 12 are illustrated. The width is measured transverse to the travel direction, the travel direction being indicated by arrow 26, and as shown in FIG. 2 the width may refer to a single food product 12 or may be the combined widths of two or more fillets 12 placed side by side on the conveyor 22.

As the food product 12 is conveyed by the bottom conveyor 22 of the slicing unit 20, the food product 12 will also be engaged by the upper conveyor 24. The upper conveyor 24 which is yieldably biased downward toward the bottom conveyor 22 will adjust according to the height of the food product 12. The upper conveyor 24 being biased downward will thus provide a force against the top of the food product 12 and thus the food product 12 will be captively held (gripped) between the lower conveyor 22 and the upper conveyor 24 as the lower conveyor 22 and the upper conveyor 24 convey the food product 12. As the food product 12 is continued to be propelled by the bottom conveyor 22 and the upper conveyor 24, the food product 12 will be conveyed into the rotational travel path of the blades 60, 62. The blades 60, 62 will slice (cut) across the food product 12 to sever a slice from the food product 12. The food product 12 being gripped between the lower conveyor 22 and the upper conveyor 24 prevents the tendency of the blades 60, 62 to pull or shift the food product 12 as it is being cut (sliced) by the blades 60, 62.

The rotational rate of the blades 60, 62 set in conjunction with the travel rate of the conveyors 22, 24 will determine the width of slice that is cut from the food product 12.

As previously mentioned, the conveyors 22, 24 and the knives 60, 62 of the first slicing unit are inclinable at an angle as designated by the letter A. This inclination will cause the slice of material cut from the food product 12 by the blades (60, 62), and hereafter the slice of material will be referred to as a slab 14, to tip over onto the lower conveyor 42 of the slicing unit 40. The rate of travel of the lower conveyor 42 and upper conveyor 44 of the slicing unit 40 is set in conjunction with the feed rate of the conveyors 22, 24 of the first slicing unit 20. The rate of travel of the conveyors 42, 44 of the slicing unit 40 may be set so that the slabs 14 are in effect laid over in a shingled (stacked) effect as illustrated in FIGS. 1 and 2. The feed rate of the conveyors of slicing unit 40 may be set so that the slabs 14 are received on the lower conveyor 42 in an end-to-end arrangement with a determined spacing between each succeeding slab 14.

The lower conveyor 42 of the slicing unit 40 conveys the slabs 14 toward the upper conveyor 44. As the slabs 14 encounter the upper conveyor 44, the upper conveyor will float or adjust to the heights the slabs 14 extend above the lower conveyor 42. The upper conveyor 44 being biased downward will thus provide a force against the slabs 14 and thus the slabs 14 will be captively held (gripped) between the lower conveyor 42 and the upper conveyor 44. The slabs 14 are propelled into the gang knives 50 where they are cut into slices of determined widths, the widths being determined by the spacing of the individual knives 54 of the gang knives 50. The counter rotating knives 60, 62 of slicing unit 40 will sever the portion of the slabs 14 that has been fed into the gang knives 50 to cut the product to length. The food product 12 has thus been sliced along the three axes to thus slice the food product 12 into cube-like portions having a determined length, width and height which are referred to as cubes 16. The slabs 14 being gripped between the lower conveyor 42 and the upper conveyor 44 prevents the tendency of the blades 60, 62 and the gang knives 50 to pull or shift the slabs 14 as they are being cut (sliced) by the blades 60, 62 and the gang knives 50.

Figure 3:
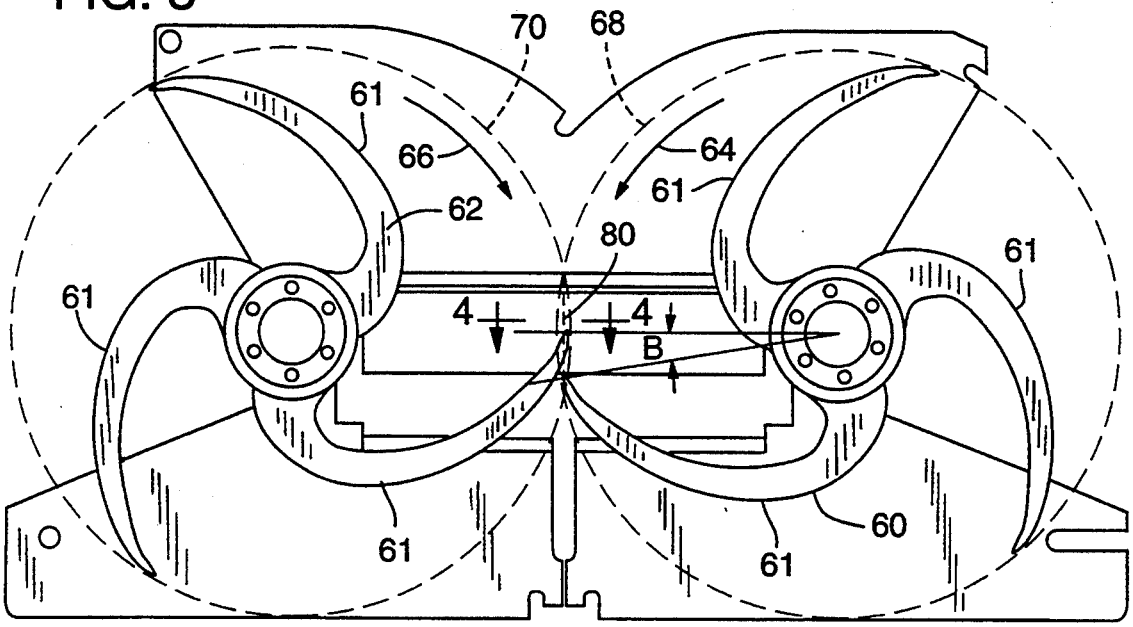
FIG. 3 is a view of the slicing blades of the automatic three dimensional slicing machine of the present invention.
Figure 4:
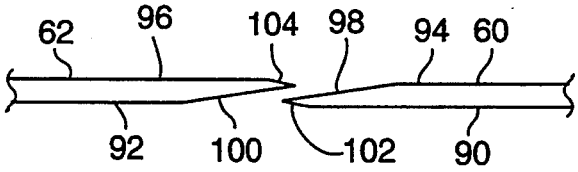
FIG. 4 is a view of the slicing blades as viewed on view lines 4–4 of FIG. 3.
Figure 5:
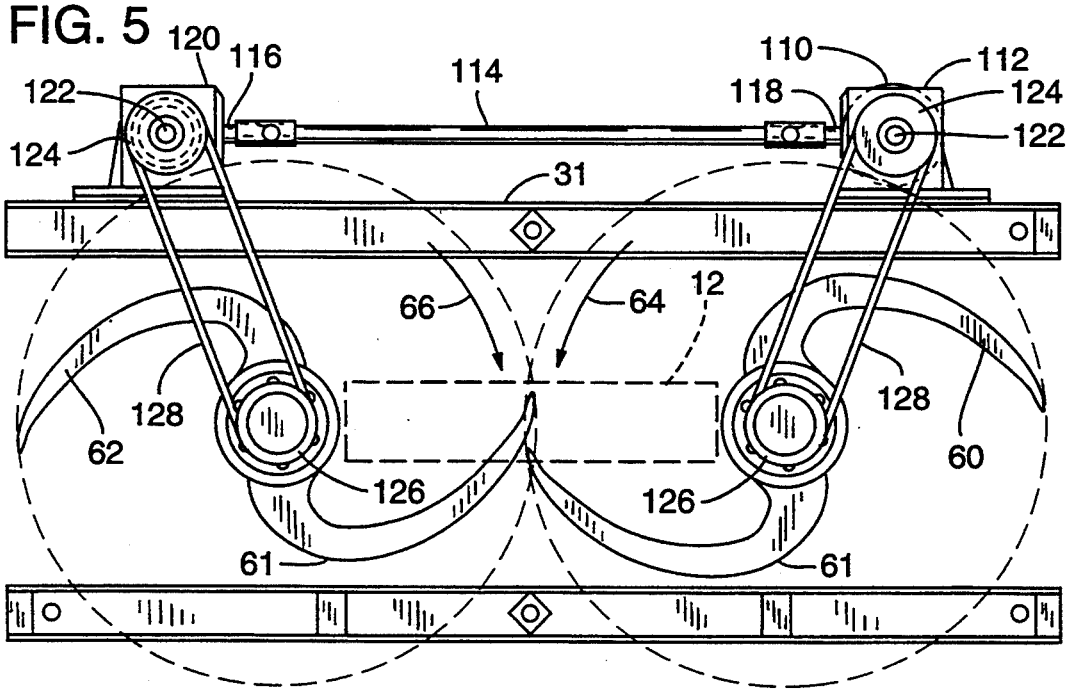
FIG. 5 is a view similar to FIG. 3 showing the drive mechanism for the slicing blades of FIG. 3.

The blades 60, 62 are further illustrated in FIGS. 3, 4 and 5. FIG. 3 illustrates a rotational relationship of the blades 60, 62 and as indicated by the directional arrows 64, 66, the blades 60, 62 rotate counter to each other. In this embodiment, the blade 60 leads the blade 62 slightly as indicated by the angle B in FIG. 3. The circular travel paths of the blades 60, 62 intersect each other as indicated by the dash lines 68, 70. The circular travel path 68, 70 of the blades 60, 62 thus have a common chord designated as 80. The chord 80 connects the common points of intersection of the circular paths 68, 70. The length of the chord 80 will thus approximate the maximum height of the product 12 or of the slab 14 that may be sliced by the two rotating blades 60, 62 to insure that the product, whether it be product 12 or slab 14, is fully sliced across its width (the width being measured transverse to the travel direction of the product 12 or slab 14 on the conveyors).

FIG. 4 illustrates the detail of a preferred blade tip overlap and offset for the blades 60, 62. For descriptive purposes, blade 60 has a side 90 referred to as a front side and a side 94 referred to as a back side. Similarly, blade 62 has a front side 92 and a back side 96. The back side 94 of blade 60 has a chamfer 98 formed at the blade edge (cutting edge) and a front side 92 of blade 62 has a chamfer 100 formed at the blade edge (cutting edge). The chamfer 98 on the back side 94 of blade 60 and a chamfer 100 on the front side 92 of blade 62 provide a clearance that minimizes any axial offset required in the mounting of blade 60 with respect to blade 62. As shown, blade 60 has a short chamfer 102 on the front side 90 and blade 62 has a short chamfer 104 on the back side 96. This complemental arrangement of the chamfers 98 and 100 minimizes the clearance required and essentially places the cutting edges of the blades 60, 62 on the same plane and therefore as the slice is produced across a product such as a large fillet 12, the full width cut will be essentially along the same plane.

FIG. 5 illustrates a drive mechanism for rotatably driving the blades 60, 62 in a synchronous and counter rotating direction. A motor such as a variable speed drive motor 110 is coupled to and drives a gear box 112 that is positioned strategic to the blade 62. A drive shaft 114 connects an output shaft 118 of gear box 112 to an input shaft 116 of another right angle gear box 120 that is positioned strategic to blade 60. Another output shaft 122 of the gear box 112 has a timing belt pulley 124 mounted thereon. Blade 62 has a timing belt pulley 126 and the gear box 112 and the blade 62 are interconnected by a timing belt 128. The gear box 112 is thus arranged to drive the blade 62 by a timing belt arrangement.

Similarly, gear box 120 is arranged to drive the blade 60 by a timing belt arrangement. Gear box 120 has an output shaft 122 on which a 124 timing belt pulley is mounted and blade 60 has a timing belt pulley 126. A timing belt 128 couples the timing belt pulley 124 of the gear box 120 to the timing belt pulley 126 of the blade 60. As shown in the figure, the blades 60, 62 are arranged to be rotatably driven counter to each other as indicated by the directional arrows 64 and 66.

Each set of blades 60, 62 are rotatably mounted to the frame 31 of the machine 10 with the mounting being strategic to the conveyors 22, 42 of the slicing units 20 and 40. The gear boxes 112, 120 and the motor 110 associated with each set of blades 60, 62 are strategically mounted to the frame 31 of the machine 10 by known conventional mounting arrangements.

FIGS. 3 and 5 also illustrate two embodiments of the blades 60, 62. FIG. 3 shows blades 60, 62 having three cutting edges or sectors and FIG. 5 illustrates a blade 62 having two cutting edges or sectors. The number of cutting edges (sectors) on each blade 60, 62 will be determined in part by the height of the food product, the type of food product, the desired dimensions of the end product and so forth. It will be appreciated that the blades 60, 62 illustrated are provided as examples and the blades 60, 62 may be provided with cutting edges (sectors) other than those illustrated.

Those skilled in the art will recognize that modifications and variations may be made without departing from the true spirit and scope of the invention. The invention is therefore not to be limited to the embodiments described and illustrated but is to be determined from the appended claims.

We claim:

1. A slicing machine arranged to slice a food product into end products having determined dimensions comprising:

a first slicing unit comprising a conveyor, a slicing station, and a drive mechanism;

said conveyor defining a directional pathway having a width and sides;

said slicing station including a pair of slicing blades, one blade pivotally mounted at each side of the pathway and pivotable transverse to the pathway, said pair of blades in combination extending across the pathway and encompassing the full width thereof;

said drive mechanism arranged to control the pivoting movement of said blades for cooperative counter rotation of the blades in a common plane and synchronized to simultaneously pivot across the pathway;

said conveyor conveying the food product along the directional pathway to the slicing station whereat said pair of slicing blades slices an end product off the food product.

2. A slicing machine as defined in claim 1 wherein:

a chamfer is formed on a cutting edge of each blade of said pair of slicing blades and the chamfer of one slicing blade is complemental to the chamfer of the other slicing blade.

3. A slicing machine as defined in claim 2 wherein:

each slicing blade of the pair of slicing blades has multiple sectors.

4. A slicing machine as defined in claim 3 further including:

a second slicing unit including a conveyor, a slicing station and a drive mechanism as defined for the first sliding unit;

said second slicing unit aligned with said first slicing unit whereby the slices of the first slicing unit are received on the conveyor of said second slicing unit.

5. A slicing machine as defined in claim 4 wherein:

said conveyor of said first slicing unit and said conveyor of said second slicing unit cooperatively define said directional pathway.

6. A slicing machine as defined in claim 5 further including:

a frame;

said first slicing unit and said second slicing unit mounted on said frame.

7. A slicing machine as defined in claim 6 wherein:

said first slicing unit inclinably mounted relative to said frame whereby said first slicing unit is inclinable relative to said second slicing unit.

8. A slicing machine as defined in claim 7 wherein:

the slicing station of said second slicing unit includes gang knives, said gang knives aligned with the conveyor of said slicing unit and in said directional pathway.

* * * * *